US006260628B1

(12) United States Patent
Magnus

(10) Patent No.: US 6,260,628 B1
(45) Date of Patent: Jul. 17, 2001

(54) USE OF STATIC MIXING ELEMENT IN CONNECTION WITH FLOW OF GAS AND LIQUIDS THROUGH A PRODUCTION TUBING

(76) Inventor: Arne Johannes Magnus, Lybekkveien 6, N-0385 Oslo (NO)

( * ) Notice: Subject to any disclaimer, the term of this patent is extended or adjusted under 35 U.S.C. 154(b) by 0 days.

(21) Appl. No.: 09/485,981

(22) PCT Filed: Aug. 19, 1998

(86) PCT No.: PCT/NO98/00245

§ 371 Date: May 1, 2000

§ 102(e) Date: May 1, 2000

(87) PCT Pub. No.: WO99/11905

PCT Pub. Date: Mar. 11, 1999

(30) Foreign Application Priority Data

Aug. 19, 1997 (NO) ..... 973807

(51) Int. Cl.[7] ..... E21B 43/12; E21B 43/25

(52) U.S. Cl. ..... 166/372; 166/177.7; 166/242.1; 166/369

(58) Field of Search ..... 166/369, 370, 166/372, 177.7, 242.1

(56) References Cited

U.S. PATENT DOCUMENTS 3,653,717 * 4/1972 Rich et al. ..... 299/5
3,727,691 * 4/1973 Muecke et al. ..... 166/295
3,923,288 * 12/1975 King ..... 259/4
4,267,885 * 5/1981 Sanderford ..... 166/250
4,648,455 * 3/1987 Luke ..... 166/303
4,725,287 * 2/1988 Gregoli et al. ..... 44/51
4,832,127 5/1989 Thomas et al. .
5,190,103 * 3/1993 Griston et al. ..... 166/250
5,452,765 9/1995 Blanchard et al. .
5,535,825 * 7/1996 Hickerson ..... 166/302
5,547,021 8/1996 Raden .

FOREIGN PATENT DOCUMENTS 1300002 5/1992 (CA) .
146826 9/1982 (NO) .

* cited by examiner

*Primary Examiner*—Hoang Dang
(74) *Attorney, Agent, or Firm*—Frommer Lawrence & Haug LLP; William S. Frommer

(57) ABSTRACT

The present invention relates to a method and a device in connection with a method for transport or flow of gas and liquid in a pipe, by which method there is in the overall or part of the pipe mounted static mixing elements for achieving favorable flows in the pipe, and for the purpose of being able to stimulate petroleum wells which have terminated production or almost terminated production due to high pressure head resistance, it is according to the invention suggested that the pipe which is used, is a production tubing or production string extending substantially vertically from a production reservoir having a low pressure, and that the mixing elements residing in the tubing is arranged in such a manner that the gas bubbles in the oil are distributed optimally as carriers in the oil, for thereby reducing and evening out the pressure head resistance in the tubing.

16 Claims, 3 Drawing Sheets

USE OF STATIC MIXING ELEMENT IN CONNECTION WITH FLOW OF GAS AND LIQUIDS THROUGH A PRODUCTION TUBING

FIELD OF THE INVENTION

The following invention relates to a use in connection with transport or flow through a production tubing string in a petroleum well of gas and liquid from a petroleum reservoir with low pressure, where the flowing fluid comprises a substantial liquid part and a less gas contribution, which gas mostly flows or bubbles past or through the liquid in the production tubing.

BACKGROUND OF THE INVENTION

In other words, it can be said that the present invention relates mainly to the type of petroleum wells which may be termed an oil producer, such oil producer producing mainly oil and some gas. This is different from petroleum wells (reservoirs) which are termed gas producers, which gas producers often also produce some liquid, for example in the form of condensate and water. By such a liquid production (in a gas well) and low pressure in the reservoir, such a well could, however, gradually "drown", and the need for gas lift may be required. Thus, the present invention also relates to gas lift for gas wells.

Most petroleum producers (wells) will have a characterization somewhat between these extremes (liquid with some gas—gas with some liquid), the liquid parts here being considered as having reasonably low viscosity.

When an oil producer (with some gas included) gradually looses its productivity by falling reservoir pressure (and lowest practical receiving pressure above ground), the pressure head in the production tubing will gradually balance the reservoir pressure. Production will then stop and the liquid level in the well will gradually come to rest below ground level.

Gas which is still released from the oil production tubing and in the zone close to the perforation, will bubble up through the production string, and then without effectively contributing to the reduction of pressure head.

It is in connection with this type of wells that the present invention has been developed.

By such oil producing wells also the residual gas will gradually be terminated, and in order to prevent such wells from "dying" it is common to introduce gas lift to reduce the pressure head resistance.

However, the present invention is to the fact of utilizing the previously ineffective gas bubbles flowing through or bubbling past the liquid in a production tubing string, and then in a surprising and new manner.

PRIOR ART

From prior art there should be mentioned applicant's NO-C-146.826 relating to the evening out of multi-phase flow by means of static mixing elements.

Further, there are known static mixing devices in a well from CA-C-1.300.002 and U.S. Pat. No. 4.832.127, but in these cases steam and water, respectively, are introduced in order to improve the well productivity.

COMPARISON WITH PRIOR ART

It is previously known from applicant's NO patent 146.826 to use static mixing elements in rising pipes, but then in connection with a different type of application, namely a typical petroleum platform riser pipe, in which slugging flow may occur. The static mixing elements are then mounted in order to even out or prevent the development of such flow slugging, and the used mixing elements must in this connection be regarded as energy damping or friction stimulating elements, which contributes in dampening the excessive or pulsing energy giving rise to said "slugging". In other words, the flow pattern is transferred from "slugging" to "mist flow" due to the changed hydraulic conditions introduced by the mixing elements.

In contrary to such a use in order to avoid "slugging", one has in connection with oil producing reservoir found that even if the mixing elements in their basic design are to be regarded as friction elements, they can surprisingly be used as liquid lifters for petroleum wells which produce substantially only liquid, which in turn is too heavy to lift itself.

Without such mixing elements the few gas bubbles which appear in the production tubing string, will only be greater and greater the further up they rise, which is to the fact that they become more and more ineffective as regards their lifting contribution. By using static mixing elements in that type of production reservoir which is the case here, it has surprisingly been found that the otherwise by-bubbling or through-bubbling gas will be finely distributed with such a fineness in the dominating liquid volume, that there is obtained a lower pressure head and thereby a stimulating lifting effect for the resulting liquid/gas-mixture. Consequently, according to the invention, an instruction of how the gas bubble energy can be channelled or converted into an energy stimulating result is obtained.

Likewise, by introducing, according to the invention, a string of mixing elements in the production piping string, the need for gas lift will be reduced because there is achieved a lower mean pressure head, and then at a lower total gas flow rate. By only introducing a string having such mixing elements in a production well of the stated art, before the well is completely dead, it will thus be possible to increase the lifetime of the well until, sooner or later, it is necessary to introduce additional gas lift. For gas wells having low pressure and liquid production, wherein gas lift is installed, the requirement for lifting gas will also be reduced by the introduction of a string of mixing elements.

BRIEF DESCRIPTION OF THE INVENTION

The present invention provides not only an instruction for a specific field of application, but also the unexpected utilization of "useless" large bubbles in the form of distributed "small bubble carriers". This involves providing the liquid and the gas to have an effective mean density which in character tends towards a single-phase flow.

It is important to recognize in the present case, that the introduction of mixing elements in a production tubing, wherein productivity is satisfactory will not contribute to a further improvement of the productivity, but rather a reduction due to the increased fall in pressure. Nevertheless, one has in connection with the present invention surprisingly found that the introduction of the mixing elements in a well at falling reservoir pressure, wherein the pressure head in the production tubing gradually evens out the reservoir pressure, will involve the exact opposite result, i.e. such "reduction elements" will operate in a completely opposite manner, namely to reduce the pressure head resistance and stimulate lifting effect for the liquid dominating liquid/gas-mixture.

Thus, especially when the production is unable to operate alone and the flow is low and the pressure head is low, the use of static mixing elements will give a positive stimulating effect by the distribution of gas in liquid.

Further features and advantages of the present invention will appear from the following description taken in conjunction with the appending drawings, as well as from the further attached patent claims.

DETAILED DESCRIPTION OF EMBODIMENTS

Figure 1:
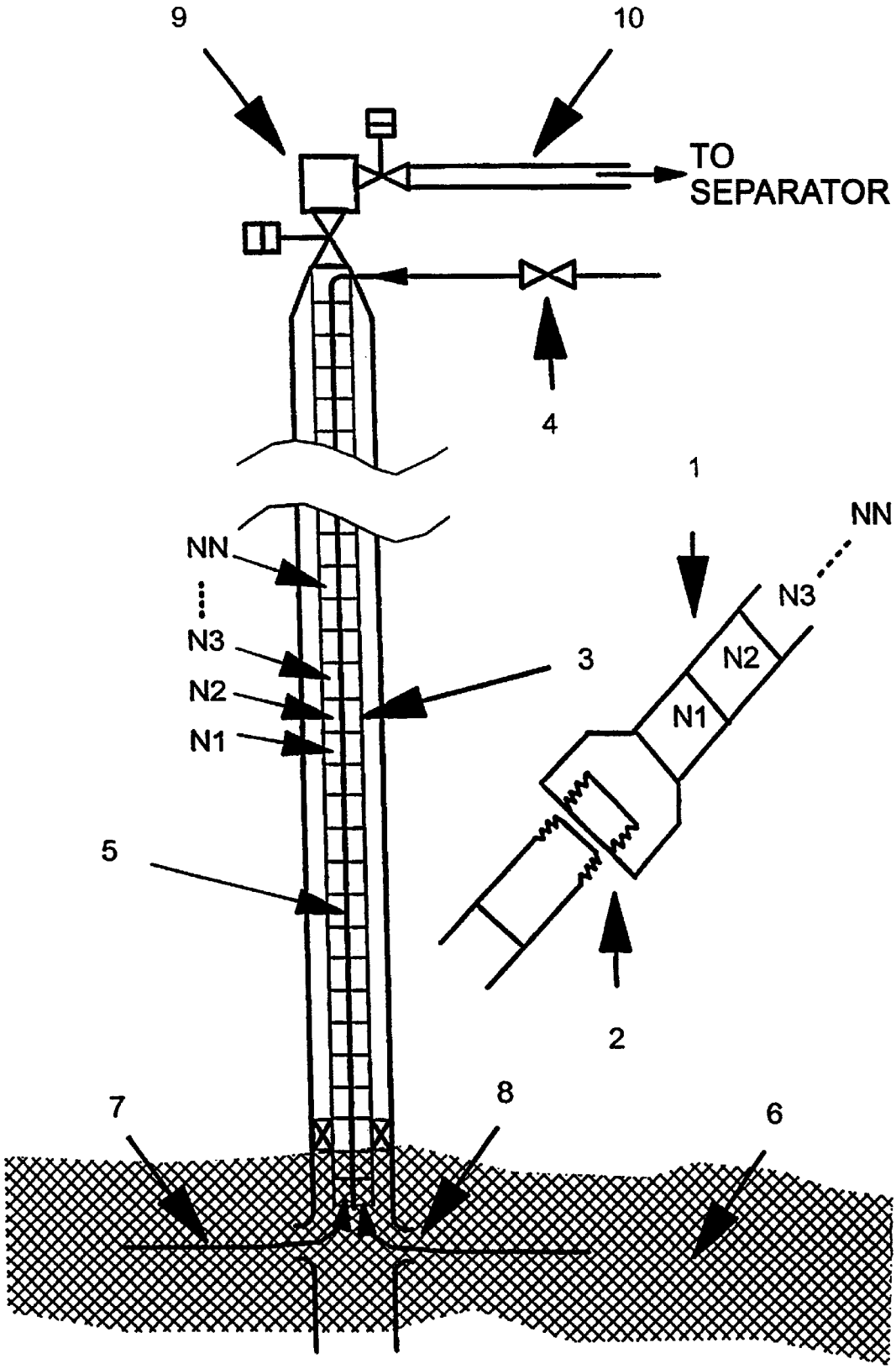
FIG. 1 is a schematical view illustrating the principle of the present invention, especially used in a production tubing string in a petroleum well, including an enlarged cut-out of the production tubing string.

The invention can be used in a petroleum well with a production tubing string as illustrated in the attached FIG. 1.

The object of the invention is to stimulate petroleum wells of the type which has terminated—or almost terminated the production, by creating an optimum gas in liquid distribution and an optimum profile of the average gas/liquid density along the extent of the production tubing string. This in order to reduce the pressure head resistance at the bottom of the string as regards the flow of gas/liquid out of the reservoir.

The type of flow patterns which are found in typical production tubings in petroleum wells, is dependent upon gas/oil conditions and the pressure in the reservoir. The invention can be utilized in petroleum wells wherein the liquid portion is decreasing or terminates its flow by low reservoir head. By low head in the reservoir and a great contribution of liquid in the flow from the reservoir to the production tubing, it will be possible that the liquid flow in the production tubing is reduced or stopped because the pressure head of the flow has become relatively too large. This because the gas to a large degree flows or bubbles past the liquid in the production tubing. In other words, by an unfavorably mixed gas and liquid (gas bubbling through the liquid) the pressure head resistance will strive towards the liquid column. By mixing the liquid and the gas in the production tubing it is possible to achieve an effective average density and a correspondingly lower pressure head resistance. In other words, by a favorable mixture of gas and liquid the mixture will have a character of striving towards a single-phase having a mean density and correspondingly lower pressure head resistance. It is this effect which is to stimulate the well flow from oil reservoirs having low pressure.

The stimulation of dying wells, or wells having a low reservoir pressure, is currently being done by stimulating the reservoir itself in order to increase the pressure at the bottom of the production tubing or by devices in the production tubing which help the liquid upwardly in the production tubing. If the stimulation of the reservoir itself to increase the pressure at the bottom of the production tubing, is not practically possibly or effective, such devices in the production tubing helping the liquid upwardly in the production tubing, will normally represent the selected method. Methods having widespread application comprises various downhole pumping devices and gas lift systems.

The use in accordance with the invention is to the fact that static mixing elements, here specifically designated as N1–NN, are mounted in pipe lengths 1 of the overall or parts of the production tubing string 3, sea the example in FIG. 1.

The elements N1–NN causes a mixing of the gas and the liquid phases, and then by means of a plurality of splittings and mergings along the extent of the pipe string. The use, which is here disclosed, is in principle not dependent upon a specific type of mixing elements, the use being substantially to the fact of improving the gas in liquid distribution and to create an optimum profile of the average gas/liquid density along the extent along the production tubing by the right choice of mixer "fineness".

In FIG. 1 it also appears that each tubing length of the production tubing string 3 appropriately can have mounted therein said static mixing elements N1–NN, which tubing lengths 1 appropriately can be screwed together through fittings 2 as a production tubing string 3 in the well in question.

Further, the embodiment of FIG. 1 illustrates that through the mounted mixing elements N1–NN there are provided a central guiding 5, to which guiding there via an appropriate upper valve 4, can be conducted possible gas for gas lifting. The guiding 5 can be made as a part of the mixing element connection.

In FIG. 1 there is also illustrated an oil zone, or an oil reservoir 6, from which gas and liquid 7 will flow through appropriate perforations 8 to said production tubing string 3 and upwards towards the well head 9. where gas and liquid via appropriate valves are passed on to a separator through a separator line 10.

It is previously known through Norwegian patent number 146.826, bearing the title "Method and equipment for evening out a rising multi-phase flow in slanting and vertical pipes", that static mixing elements can be mounted in rising pipes in order to level out, or prevent the creation of liquid "slugging". The use of the invention therein, should be a levelling out of the multi-phase flow in rising pipes (platform risers) wherein the flow rate was given, and was too low to avoid "slugging". The previously known technique had not for its objection to create an increase in the total flow in the rising pipe.

A use of static mixing elements mounted in the overall or parts of petroleum production tubing, as this is suggested according to the present invention, thus represents a new application in relation to patent number 146.826, because the objection is now to increase the total flow in dying petroleum wells. Consequently, this novel application is primarily some sort of gas lift without introduction of gas.

However, it is to be understood that the invention can be used together with gas lift in order to reduce the need for lifting gas. This for those cases wherein a further increase of the production is wanted or possible.

Figure 2:
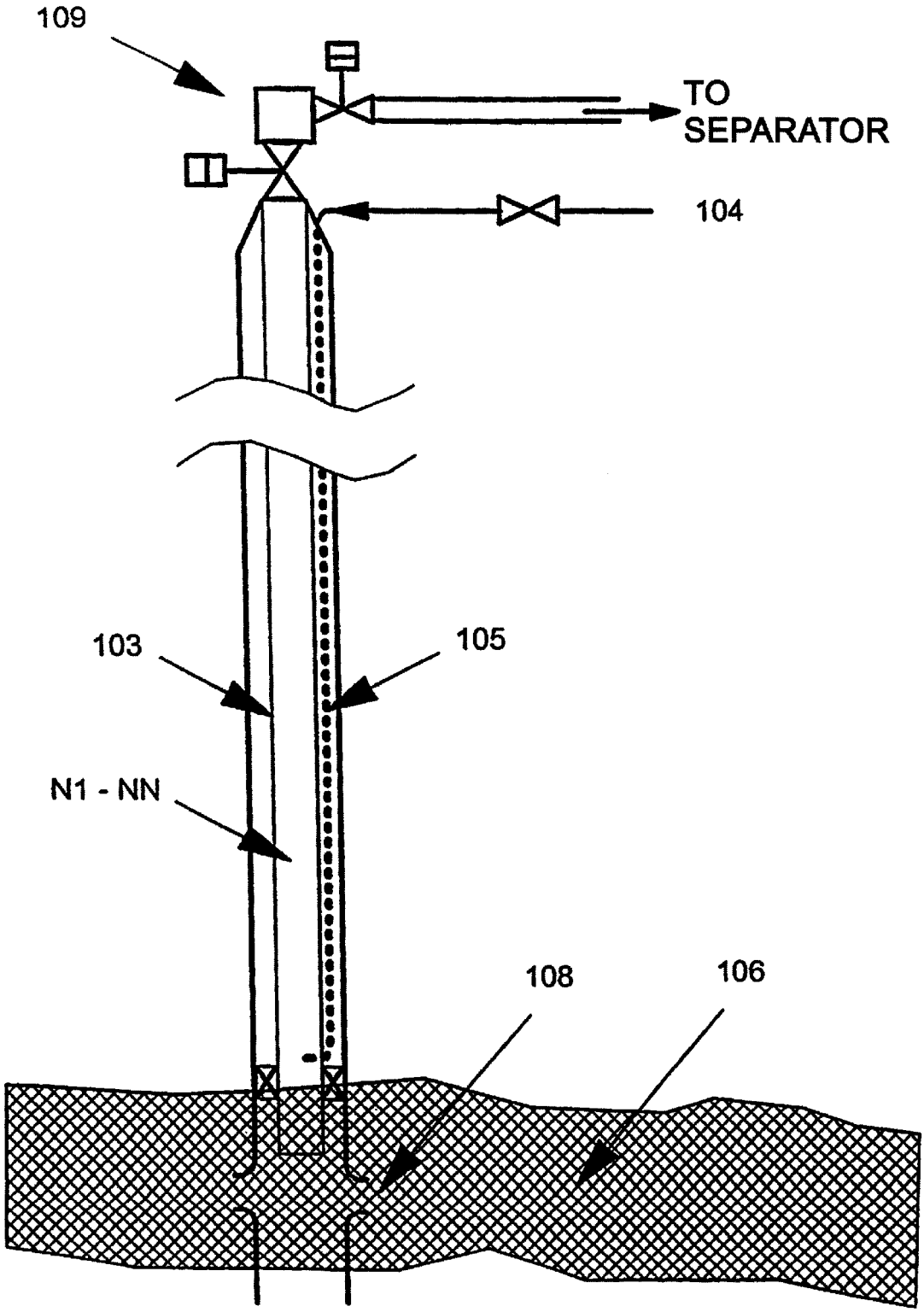
FIG. 2 is a schematical view illustrating a further embodiment of the invention.

In FIG. 2 there is illustrated a second example of a petroleum well, wherein the present invention can find its application, and wherein gas lift can also be used.

Possible lifting gas will here be supplied to the production tubing 103 via a tubing 105 which runs on the outside of the production tubing 103, said lifting gas being controlled by means of an appropriate upper valve 104.

The gas can appropriately be introduced in the production tubing 103 just above the perforations 108 towards the oil reservoir 106.

Figure 3:
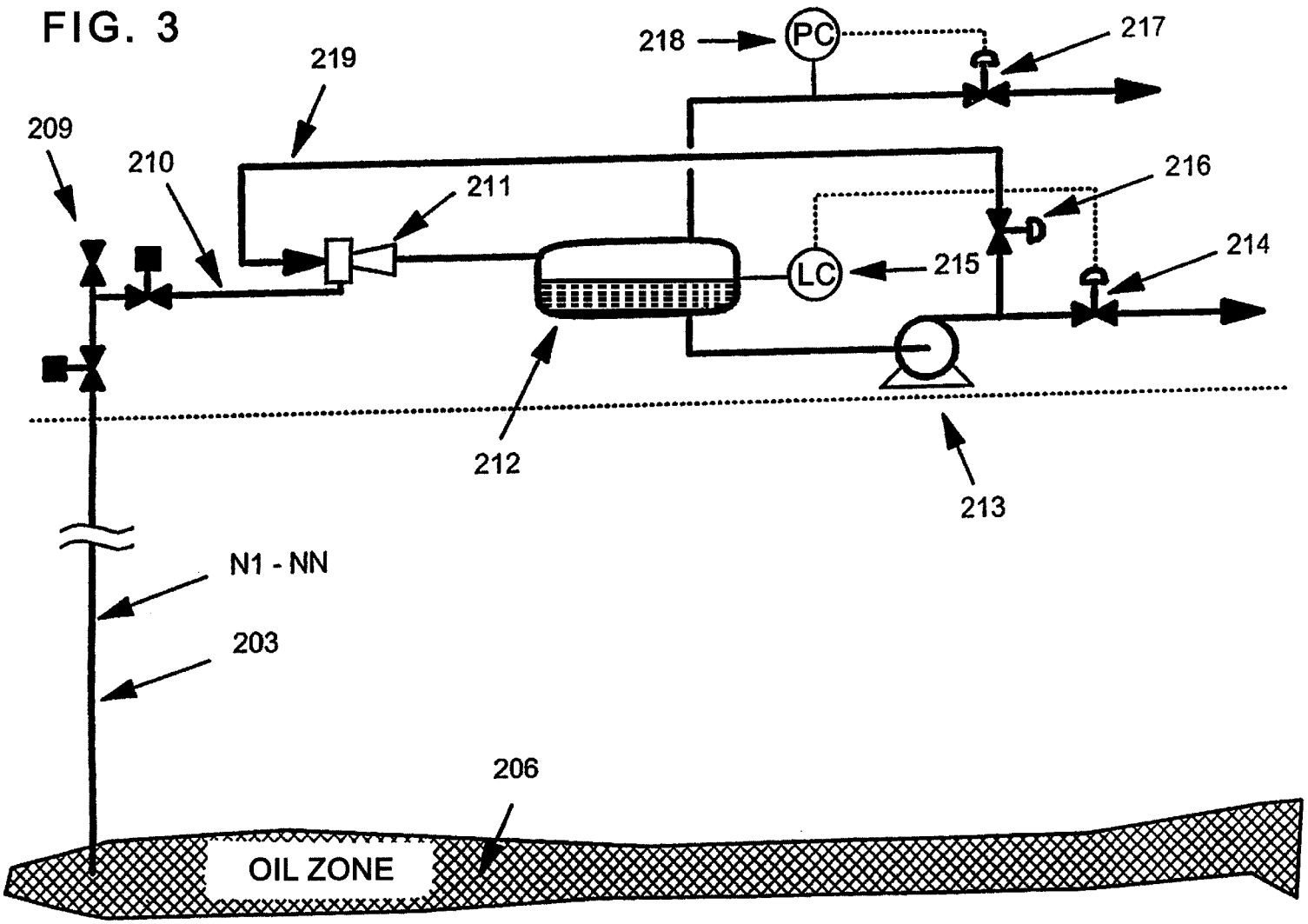
FIG. 3 is a schematical view illustrating the principle according to the invention applied in connection with further auxiliary devices.

FIG. 3 illustrates further example of the invention used in connection with further auxiliary devices.

Also here there is from an oil reservoir 206 supplied gas and liquid to the production tubing string 203 in a petroleum well, said gas and liquid being transported via the well head 209 to a separator line 210. By means of said auxiliary devices in FIG. 3 there will in the separator line 210 be created a moderate sub-pressure or vacuum, which together with the use of said discussed mixing elements N1–NN in connection with FIG. 1, will further contribute to the liquid lifting effect for petroleum wells given by the gas bubbles in the liquid containing little gas.

Even moderate vacuum will create a "Champagne" effect in the wells in question, which can be utilized to a maximum by the mixing elements N1–NN in order to reduce the pressure head resistance.

FIG. 3 illustrates also that said separator line 210 is connected with an ejector 211 which, in turn, is connected to a separator tank 212, wherein is created a small overpressure. At the bottom of the separator tank 212 there is connected a pump 213 which from the tank 212 pumps out produced oil through an oil level valve 214, which, in turn, is connected with the tank 212 via an appropriate level meter 215.

Between the pump 213 and the oil level valve 214 there is via an ejector control valve 216 connected a feedback line 219 which, in turn, is connected to said ejector 211 for control of said moderate sub-pressure at the well head 209.

From the top of the separator tank 212 there will via a gas valve 217 be tapped off produced gas, under the surveillance of a pressure meter 218.

What is claimed is:

1. A method for transport or flow of gas and liquid through a production tubing string in petroleum wells from a production reservoir having low pressure, said method comprising the steps of passing a mixture of liquid and a gas which flow through or bubbles by the liquid in the production tubing string; and arranging static mixing elements in the production tubing string to finely distribute the gas in the liquid to achieve a lower pressure head resistance and thereby a stimulating lifting effect for the resulting liquid/gas mixture.

2. The method as stated in claim 1, and further comprising the step of providing the liquid and the gas with an effective mean density which tends towards single-phase flow.

3. The method as stated in claim 1, and further comprising the steps of pre-mounting the static mixing elements in said production tubing string elements and individually removing said static mixing elements for replacement or maintenance.

4. The method as stated in claim 1, and further comprising the step of providing said static mixing elements either alone or in connection with means for supply of lifting gas.

5. The method as stated in claim 1, and further comprising the step of supplying the lifting gas in a pipe which is carried on the outside of the production tubing string.

6. The method as stated in claim 1, and further comprising the step of connecting an ejector for vacuum operation of a well head and a moderately pressurized receiving separator at the top of the production tubing string.

7. The method as stated in claim 2, and further comprising the steps of pre-mounting the static mixing elements in said production tubing string elements and individually removing said static mixing elements for replacement or maintenance.

8. The method as stated in claim 2, and further comprising the step of providing said static mixing elements either alone or in connection with means for supply of lifting gas.

9. The method as stated in claim 2, and further comprising the step of supplying the lifting gas in a pipe which is carried on the outside of the production tubing string.

10. The method as stated in claim 2, and further comprising the step of connecting an ejector for vacuum operation of a the well head and a moderately pressurized receiving separator at the top of the production tubing string.

11. The method as stated in claim 3, and further comprising the step of providing said static mixing elements either alone or in connection with means for supply of lifting gas.

12. The method as stated in claim 3, and further comprising the step of supplying the lifting gas in a pipe which is carried on the outside of the production tubing string.

13. The method as stated in claim 3, and further comprising the step of connecting an ejector for vacuum operation of a well head and a moderately pressurized receiving separator at the top of the production tubing string.

14. The method as stated in claim 4, and further comprising the step of supplying the lifting gas in a pipe which is carried on the outside of the production tubing string.

15. The method as stated in claim 4, and further comprising the step of connecting an ejector for vacuum operation of a well head and a moderately pressurized receiving separator at the top of the production tubing string.

16. The method as stated in claim 5, and further comprising the step of supplying the lifting gas in a pipe which is carried on the outside of the production tubing string.

* * * * *

UNITED STATES PATENT AND TRADEMARK OFFICE

CERTIFICATE OF CORRECTION

PATENT NO. : 6,260,628 B1
DATED : July 17, 2001
INVENTOR(S) : Arne Johannes Magnus It is certified that error appears in the above-identified patent and that said Letters Patent is hereby corrected as shown below:

Column 6,
Line 24, delete "the".

Signed and Sealed this

Eleventh Day of December, 2001

*Attest:*

Nicholas P. Godici

*Attesting Officer*

NICHOLAS P. GODICI
*Acting Director of the United States Patent and Trademark Office*